United States Patent [19]

Otto et al.

[11] Patent Number: 4,520,596

[45] Date of Patent: Jun. 4, 1985

[54] GRINDING OR POLISHING MACHINE FOR OPTICAL LENSES

[75] Inventors: Maurice J. Otto, Marseille; Jean-Pierre Peridont, Ollioules, both of France

[73] Assignee: Societe Anonyme dite: Etudes et Fabrications Optiques, France

[21] Appl. No.: 475,535

[22] Filed: Mar. 15, 1983

[30] Foreign Application Priority Data

Mar. 26, 1982 [FR] France ..... 82 05363

[51] Int. Cl.[3] ..... B24B 13/02; B24B 29/00

[52] U.S. Cl. ..... 51/55; 51/131.5; 51/215 UE; 414/225; 414/744 R; 414/758; 414/773

[58] Field of Search ..... 51/55, 162, 105 LG, 51/106 R, 124 L, 215 UE, 131.5, 134, 58; 414/225, 744, 758, 773

[56] References Cited

U.S. PATENT DOCUMENTS

| | | | |
|---|---|---|---|
| 2,704,424 | 3/1955 | D'Araucourt | 51/131.5 |
| 2,933,863 | 4/1960 | Doll . | |
| 3,857,205 | 12/1974 | Van Hare | 51/134 |
| 3,889,426 | 6/1975 | Blum . | |

FOREIGN PATENT DOCUMENTS

| | | |
|---|---|---|
| 1239211 | 10/1964 | Fed. Rep. of Germany . |
| 1499242 | 9/1967 | France . |
| 2204990 | 5/1974 | France . |
| 2277650 | 2/1976 | France . |
| 2332841 | 6/1977 | France . |
| 584919 | 1/1947 | United Kingdom . |
| 1311851 | 3/1973 | United Kingdom . |

*Primary Examiner*—Frederick R. Schmidt
*Assistant Examiner*—Robert A. Rose
*Attorney, Agent, or Firm*—Brumbaugh, Graves, Donohue & Raymond

[57] ABSTRACT

A machine is of the type comprising an oscillating movable head with a tool-holding spindle, driven in rotation above a lens-support. The lens-support is borne by a vertically movable spindle which is mounted inside a sleeve, flared out at its upper part to form two bearing surfaces and, the lens-support comprises a ledge which surrounds the part of the sleeve containing the bearing surfaces. The lens-support rests on a head mounted for free rotation in a fixed pivot so that when the spindle is moved upwardly, the lens-support is immobilized in a horizontal position, to deposit the lenses to be polished thereon, or to remove them after the polishing operation. When the spindle is moved downwardly, the lens-support, then at a distance from the bearing surfaces, can oscillate freely during the lens-polishing operation, under the effect of the movable oscillating head.

12 Claims, 14 Drawing Figures

FIG. 4
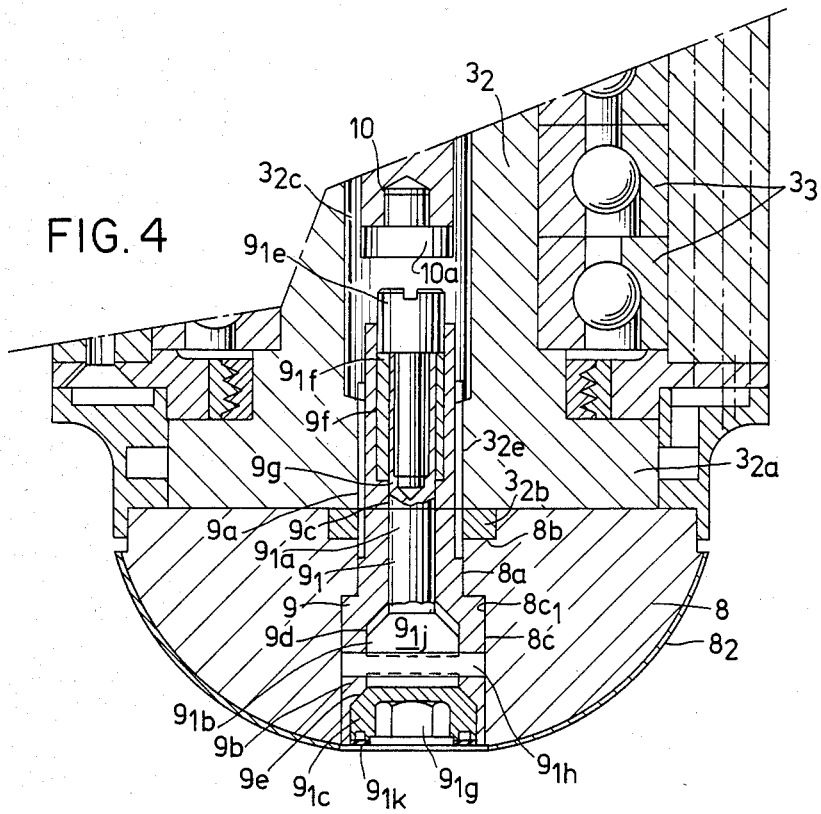
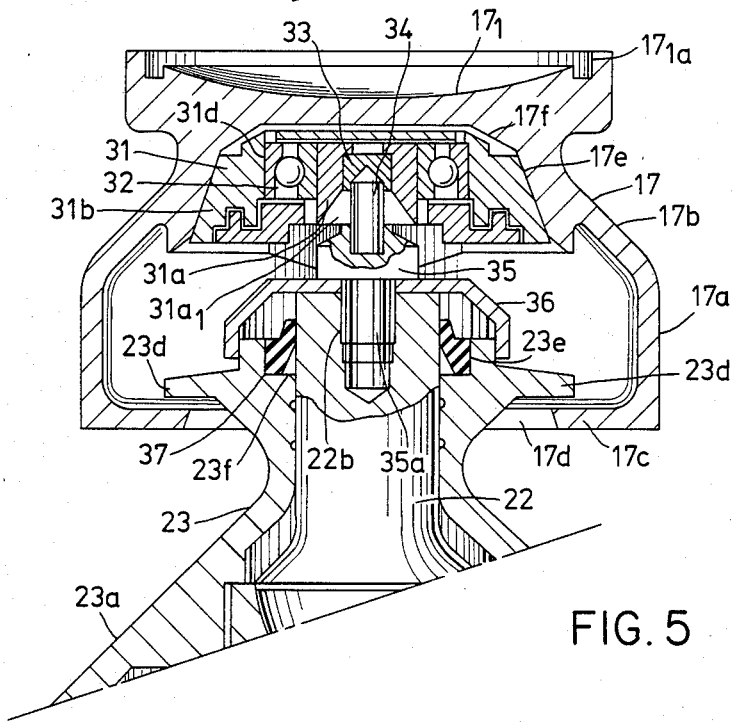
FIG. 5

GRINDING OR POLISHING MACHINE FOR OPTICAL LENSES

BACKGROUND OF THE INVENTION

The present invention relates to a grinding and polishing machine for optical lenses.

The technical sector of the invention is that of machines and devices used for polishing the surface of glass and more particularly optical glass.

It is known that the production of optical lenses goes through several stages. The lenses are first rough-shaped, then they are "ground" and finally "polished".

Roughing and grinding machines are known which work automatically and necessitate a minimum labor force. Polishing machines are also known to work semi-automatically.

SUMMARY OF THE INVENTION

It is the object of the present invention to develop a machine permitting, indifferently, the grinding or polishing of optical lenses, semi-automatically, by treating the lenses face after face, or automatically, by treating the lenses on both faces once they go through the machine.

This object is reached according to the invention with a machine for grinding or polishing optical lenses, of the type comprising a frame on which is mounted at least one spindle designed to carry a grinding or polishing tool, at least one lens-support, means for delivering a polishing agent between the tool and the support, means to bring the lenses in contact with the grinding or polishing tool, means to place lenses on the lens-support and to remove the lenses from the tool once they have been ground or polished. The lens support is mounted for free rotation on the frame, which comprises an oscillating movable head on which the tool-holding spindle is driven in rotation above the lens-support. The lens-support is carried by a vertically movable spindle which is mounted in a sleeve flared at the top to form two bearing surfaces extending horizontally and opposedly on either side of the spindle, and the lens-support is downwardly extended by a skirt, which is provided with a ledge extending towards the center of said support to enclose the part of the sleeve which comprises said bearing surfaces. The lens-support rests on a head mounted for free rotation on a fixed pivot situated at the top of said spindle, so that when the spindle is moved upwardly, the support comes to rest on said bearing surfaces and is immobilized in a horizontal position to lay the lenses thereon, in order to polish them, or to remove them once they have been polished, and so that when the spindle is moved downwards, the support, being apart from said bearing surfaces, can oscillate freely during the polishing of the lenses under the effect of the oscillating movable head.

The result of the invention is a machine for grinding or polishing optical lenses which comprises either one treating device for semiautomatically polishing the lenses or two devices for automatically polishing the two surfaces of the lenses.

The advantages of such a machine reside mainly in the fact that a plurality of devices can be operated by only one person.

BRIEF DESCRIPTION OF THE DRAWING

The invention will be more readily understood on reading the following description with reference to the accompanying drawings, in which:

FIG. 4 is a cross-section of the lower part of the oscillating head illustrating more particularly the grinding or polishing tool and the device used for ejecting the lenses after polishing;

FIG. 5 is a cross-section illustrating on a larger scale, how the lens-support is mounted;

DETAILED DESCRIPTION OF THE PREFERRED EMBODIMENT

Figure 1:
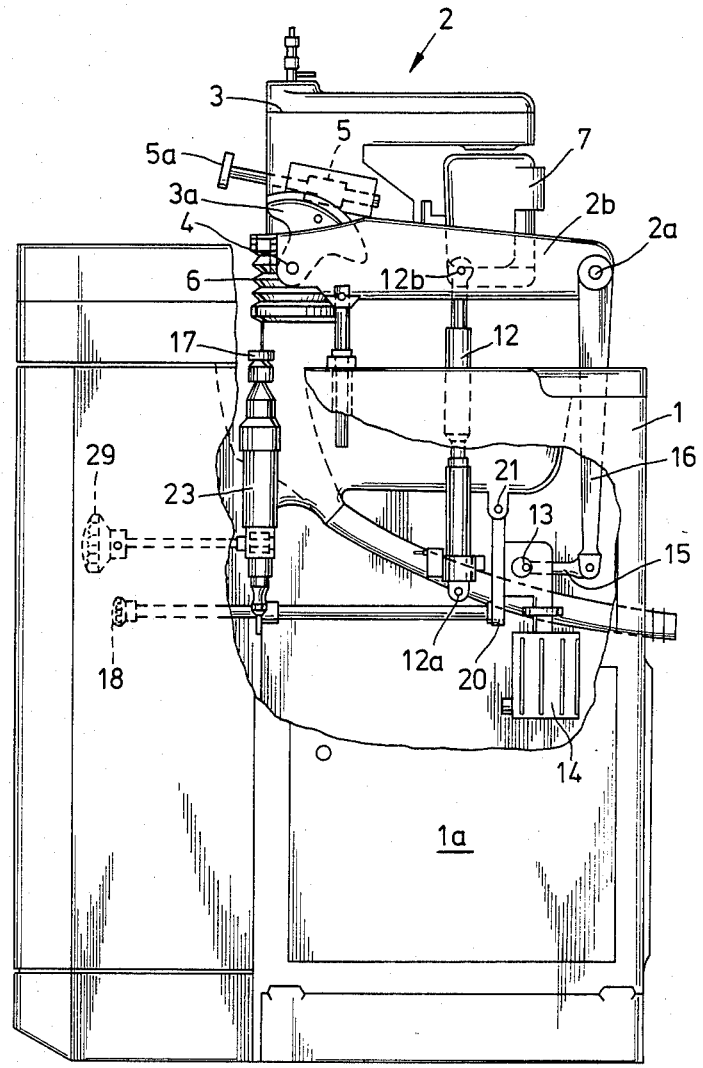
FIG. 1 is a side view of the machine according to the invention.

Referring first to FIG. 1 of the drawings, which diagrammatically illustrates a machine according to the invention, the machine comprises a frame 1 which is, contained inside a cabinet provided with doors 1*a* giving access to the members of the machine.

The machine comprises, at its upper part, an oscillating tool-holding head 2 which is mounted for pivoting about a horizontal axle 2*a*, which axle is situated at the rear end of an arm 2*b*, and carries at its end opposite said axle 2*a*, an orientable movable head 3. Said head comprises a chassis and is mounted on the arm 2*b* for pivoting about an axle 4. Said head is also provided on one side with a toothed sector 3*a* which cooperates with an worm gear 5, carried by the arm 2*b* and controlled by means of a control wheel 5*a*. The polishing or grinding tool is situated inside a protective screen composed of a bellows sleeve 6 which fully surrounds the tool in order to protect it from any projections of the polishing agent.

The tool is driven in rotation by an electric motor 7 and a transmission composed, for example, of trapezoidal belts. The orientable movable head 3 is illustrated on a larger scale in FIG. 2 of the drawing. It is composed of a support $3_1$ in which the tool-carrying spindle $3_2$ is mounted for rotating around roller bearings $3_3/3_4$. Spindle $3_2$ extends beyond the upper part of the support $3_1$ and comprises, at its upper end, a grooved pulley $3_5$, which is keyed on to the spindle.

Said orientable head 3 further comprises, at its upper part, a housing $3_6$ which encloses the part $3_5$ and that, not shown, which is wedged on the output shaft of the motor 7 and the trapezoidal transmission belts.

Figure 8:
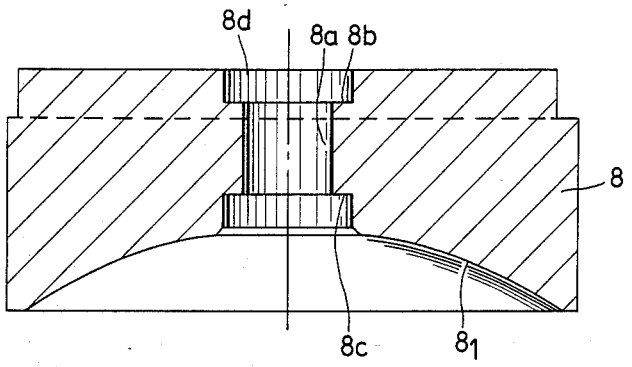
FIG. 8 is a cross-section of a tool for polishing the convex part of the lenses.
Figure 9:
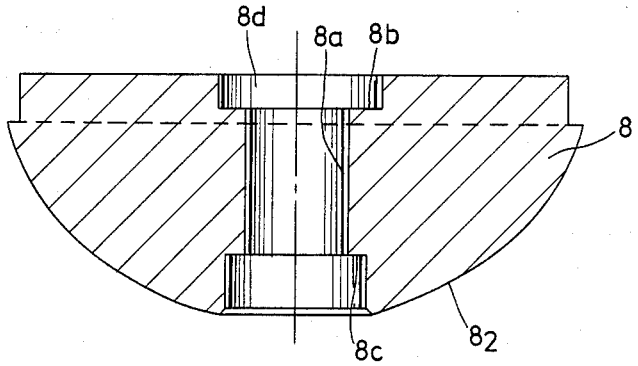
FIG. 9 is a cross-section of a tool for polishing the concave part of the lenses.

The spindle is provided at its lower part with the polishing or grinding tool 8. Said tool (FIGS. 8 and 9) is in the form of a cylindrical plate. FIG. 8 illustrates a section of such a plate, through its diameter, which is used to polish the convex part of the lenses. Its lower part $8_1$, which comes into contact with the lenses is concave and of general spherical shape, said lower part being coated with a layer of synthetic material, such as for example polyurethane. FIG. 9 illustrates a sectional view through its diameter of the tool used for treating the surface of the concave part of the lenses. The lower part of the tool $8_2$ which comes into contact with the lenses is convex and of general spherical shape and is coated, just as part $8_1$ of FIG. 8, with a layer of polyurethane.

The tool 8 is provided in its center with a bore forming shoulders 8*b*/8*c* permitting to mount it on the lower part of the tool-carrying spindle $3_2$.

With reference to FIG. 4, said spindle $3_2$ is cylindrical and comprises, at its lower part, a part $3_2a$ of larger diameter adopting the shape of a plate on which the tool 8 can rest. Said plate comprises, in its center, a cylindrical centering boss $3_2b$ which penetrates into a cylindrical housing 8*d* provided at the upper part of the tool.

Said spindle $3_2$ is hollow in its center and through from its upper end to the plate $3_2a$, and thus comprises a cylindrical chamber $3_2c$ issuing at its upper end $3_2d$ which is co-axial to the spindle.

Chamber $3_2c$ extends into the axis of the spindle through the plate $3_2a$ via a tapped hole $3_2e$ in which is screwed the axle 9 by which the tool 8 is fixed on the spindle $3_2$. Said axle is cylindrical and is threaded at its part 9*a* so as to cooperate with the tapping $3_2e$ and comprises at its lower end a cylindrical head 9*b* of larger diameter. Said axle 9 is hollow in its center and comprises, from its upper end to its lower end, a cylindrical conduit 9*c*, which extends up to the head 9*b*, a first cylindrico-conical chamber portion of larger diameter than said conduit, and a second cylindrico-conical chamber portion of larger diameter than the first chamber portion, designated collectively as 9*d*. The axle 9 comprises at its upper end, a cylindrical housing 9*f* extending approximately over half the length of the axle. Said latter comprises in its central part, a push-member $9_1$ which extends from its lower part to its upper part and beyond. Said pushmember $9_1$ is composed of a cylindrical rod $9_1a$, extended at its bottom part by a first cylindrical protuberance $9_1b$, said latter being extended by a second protuberance $9_1c$.

Protuberances $9_1c/9_1b$ and the rod $9_1a$ are respectively engaged in chambers 9*e*/9*d* and in conduit 9*c*. The part of the push-member which extends from the axle, at its upper part, is constituted by a screw-head $9_1e$, screwed in a tapped hole provided at the center of the rod $9_1a$. A compression spring $9_1f$ placed inside the housing 9*f*, surrounds the rod $9_1a$ and extends from the head of the screw $9_1e$ to a shoulder $9_g$ on which the spring $9_1f$ is resting.

Under the pressure of the spring $9_1f$ and in the initial position of the push member $9_1$, the cylindrical protuberance $9_1c$ is in abutment in its housing 9*e*. In this position, said protuberance is flushed with the lower part of the axle.

Said protuberance $9_1c$ is provided in its center with a blind hole $9_1g$ forming a six-sided hole, in order to be able to operate the axle by means of a spanner and to screw it in or out of the spindle $3_2$ when fitting in or removing the tool 8. To this effect, the push-member is linked in rotation with the axle 9 by way of a pin $9_1h$ which extends diametrically to the axle and is secured thereto by its ends being force-fitted into the holes provided in the wall of the chamber 9*d*, said pin traversing a diametral slot which is rectangular with rounded edges $9_1j$, provided in the said protuberance $9_1b$. Said slot $9_1j$ is large enough to allow the retraction of the head screw $9_1e$ when a pressure is exerted on its top part, thus causing the protuberance to come out of the push member and thus separating the lens which is stuck on the tool 8 at the end of the polishing.

In order to protect the surface of the glass in contact with the push member, said latter is provided with a washer in soft synthetic material such as polyurethane $9_1k$. As shown in FIG. 4, the push-member $9_1$ is in its initial rest position, slightly retracted with respect to the periphery $8_2$ of the tool 8.

Figure 2:
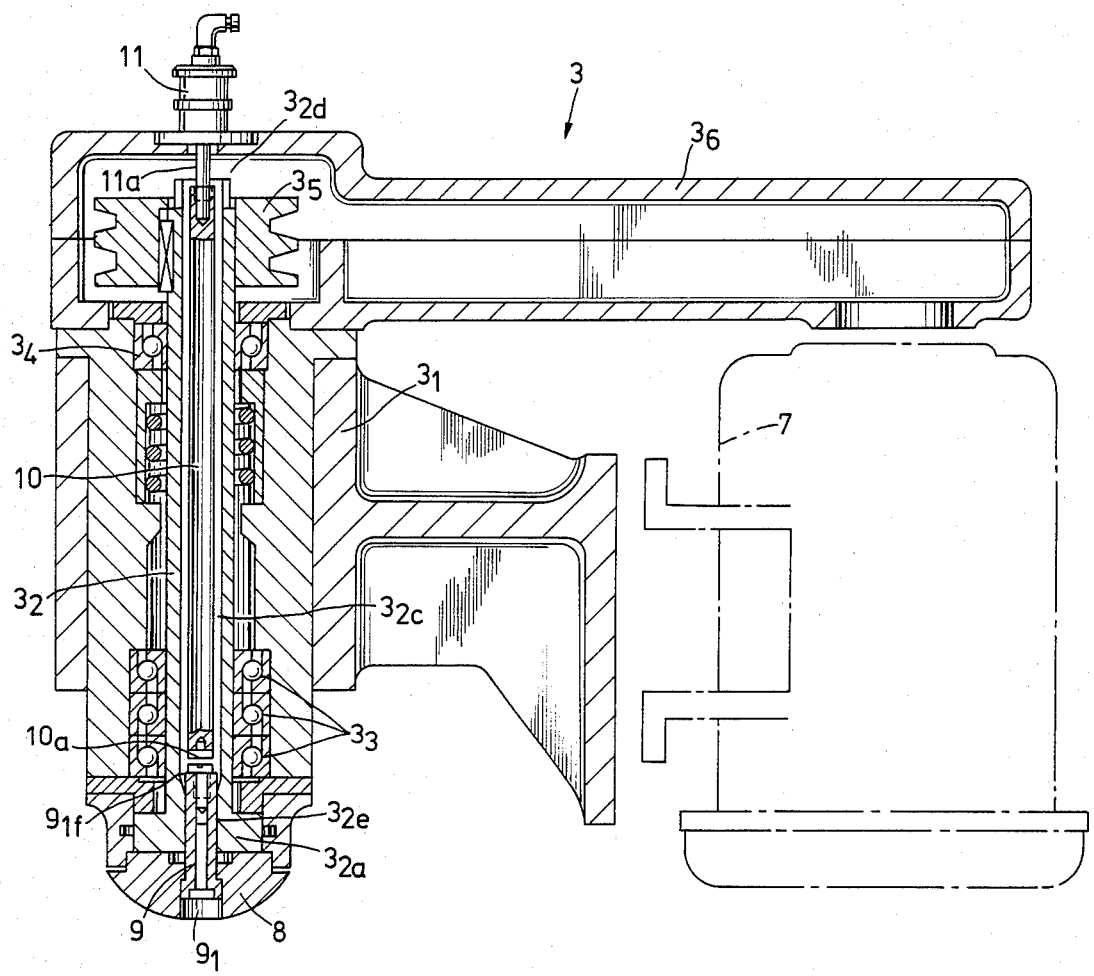
FIG. 2 is a longitudinal section of the oscillating head.

Referring to FIG. 2, said push-member $9_1$ is actuated by a rod 10, situated in the cylindrical chamber $3_2c$ and secured to the movable rod 11*a* of a jack 11, which may be a hydraulic jack, mounted on the housing $3_6$ of the movable head 3 coaxially to the rod 10 and to the spindle $3_2$. The end 10*a* of the rod 10 is close to the head of the screw $9_1e$ forming the upper part of the push-member $9_1$. The lenses are detached from the tool by means of the jack 11 which, being pressurized, acts via the rod 10, on the push-member $9_1$. The oscillating tool-holding head 2 is borne by a double-acting jack 12, mounted for pivoting by its end 12*a* on the frame 1 of the machine and by its end 12*b* on the arm 2*b* of said head 2. The oscillation of the head 2 is obtained by means of an eccentric 13 wedged on the output shaft of a motor-reducer 14 and of a connecting rod assembly 15/16. The connecting-rod 15 is mounted for pivoting on the end of the connecting rod 16, which latter is mounted for pivoting in 2*a* on the arm 2*b*. The position of the head 2 and of the grinding or polishing tool is adjusted with respect to the lens-support 17 by means of a wheel 18, wedged on the end of a threaded pin 19, mounted on said frame 1 and acting on a support member 20, mounted for pivoting on said frame about a horizontal axle 21, on which support member 20 is fitted the motor-reducer 14.

The lens-support 17 is borne by a spindle 22, disposed in a cylindrical sleeve 23 mounted for sliding inside a boss 1*b* of the frame 1 and extending vertically so that the upper face of the member 17 on which the lens is rested, is contained inside a horizontal pane when this particular operation is carried out.

Figure 3:
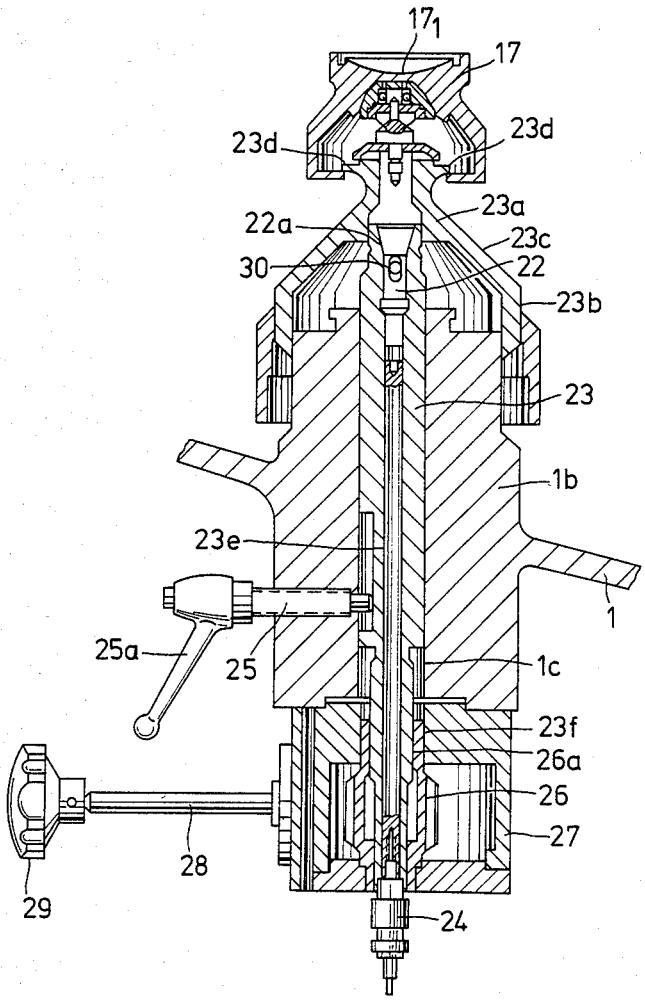
FIG. 3 is a partial cross-section of the machine showing how the lens-support is mounted on the spindle.
Figure 10:
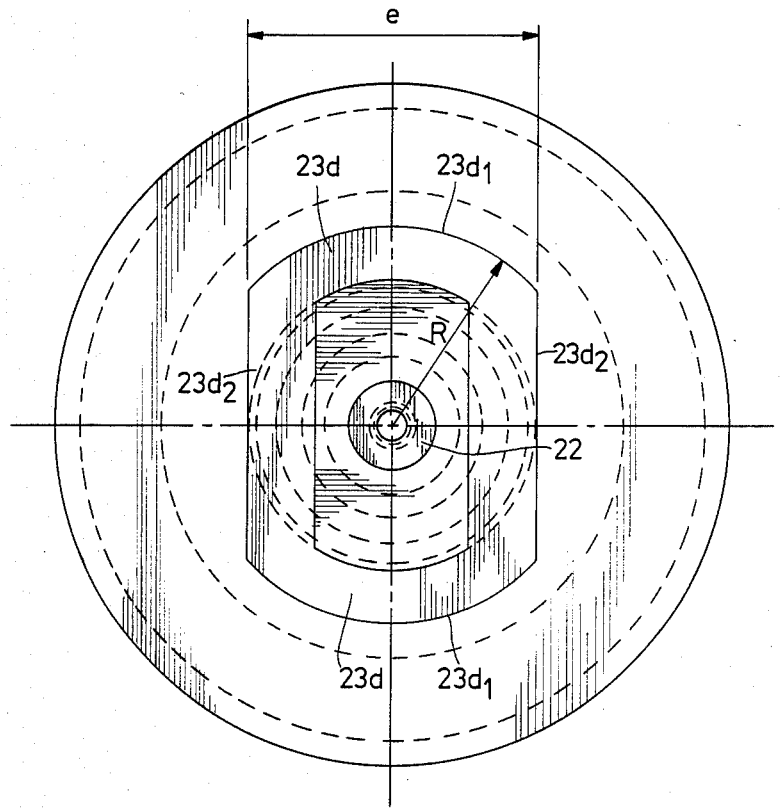
FIG. 10 is a plan view of the sleeve inside which is mounted the spindle carrying the lens-support.

Turning now to FIG. 3, said sleeve 23 comprises, at its upper part, a cover 23*a* which is screwed on, and comprises a cylindrical part 23*b* which covers, with a slight play, the upper part of the boss 1*b*, said cylindrical part being extended upwards by a conical part 23*c*, which latter is flared at its upper part to form two diametrically opposite bearing surfaces 23*d* extending inside a horizontal plane. Said bearing surfaces 23*d* are shown from beneath in FIG. 10 of the drawings. They are defined at their end by a circular line $23d_1$ of radius R and laterally by two straight parallel lines $23d_2$ separated by a distance E, and symmetrical with respect to the longitudinal axis of the spindle 22. Said latter is mounted for sliding in the sleeve 23, extends over the length thereof and is secured by its lower end to a preferably pneumatical double-acting jack 24. The height of said sleeve 23 is adjustable in relation to the boss 1*b* in which it is mounted inside a cylindrical conduit 1*c* co-axial to said boss and comprises a flat 23*e*, provided on the side of its lower part on which flat rests a lock-screw 25 which comprises an operating lever 25*a* cooperating with a tapped hole made in the boss 1*b* and extending perpendicularly to the axle of said spindle 22 and of said sleeve 23. Said latter is extended at its lower part by a pinion 26 mounted in a casing 27 and meshing with an worm gear (not shown), mounted on a shaft 28 which extends orthogonally to the pinion 26 and is equipped at its free end, with a control wheel 29. Said spindle 22 is free in translation along its longitudinal axis inside the sleeve 23 and is fast in rotation therewith. It comprises, on its upper part side, a rectangular diametral slot with rounded edges 22*a*, inside which is fitted a pin 30 which extends transversely and is force-fitted into holes provided in the wall of the sleeve 23. Said sleeve is threaded at its lower periphery and cooperates with an internal threading 26*a* of the pinion 26. When the lock-screw 25 is untightened, it is obviously conceivable that to operate the wheel 29 in one direction or the other, causes the vertical displacement either upwardly or downwardly of the sleeve 23 and of the spindle 22. When the desired position is reached, the assembly is locked in position by way of the lock-screw 25.

Figure 6A:
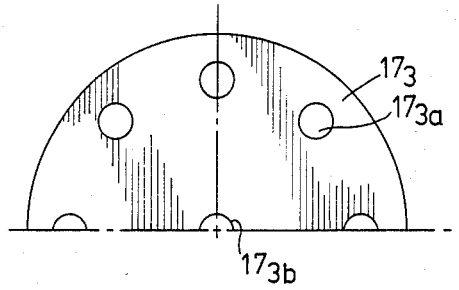
FIG. 6A is a partial plan view of the coating of the lens-supporting surface of FIG. 6B.
Figure 6B:
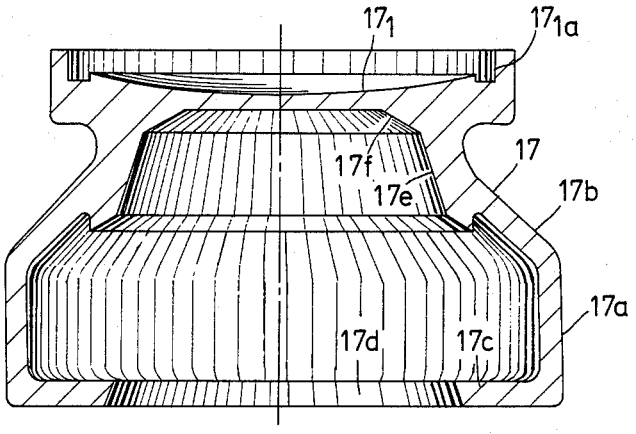
FIG. 6B is a cross-section of said support, the lens-supporting surface of which is concave.
Figure 7A:
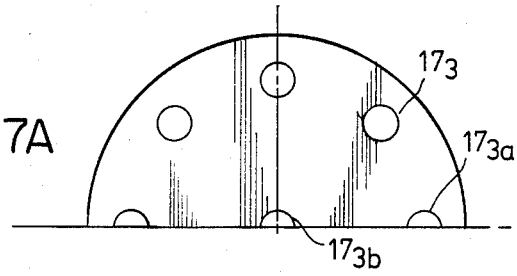
FIG. 7A is a partial plan view of the coating of the lens-supporting surface of FIG. 7B.
Figure 7B:
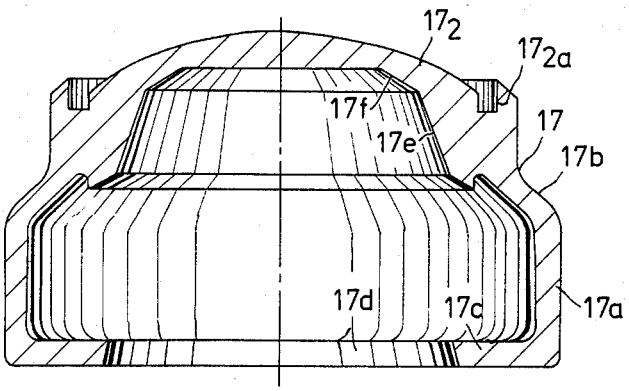
FIG. 7B is a cross-section of said support, the lens-supporting surface of which is convex.

FIGS. 6A, 6B, 7A and 7B illustrate the lens-support 17 in two possible embodiments. The support of FIGS. 6A and 6B is designed to receive the convex part of the lens to be polished, whereas the member shown in FIGS. 7A and 7B is designed to receive the concave part of the lens.

The lens-support 17 is of a generally cylindrical form and the bearing surface $17_1/17_2$ of the lens extends orthogonally to its longitudinal axis. The surface $17_1$ of the support 17 shown in FIG. 6 is concave, of general spherical shape and comprises at its periphery a ledge $17_1a$ to hold the lens laterally during the polishing operation. The surface $17_2$ of the member 17 shown in FIG. 7 is convex and of general spherical shape and comprises at its periphery a chamfered ledge $17_2a$ to hold the lens laterally during the polishing operation.

The curved surfaces $17_1/17_2$ are coated with a layer $17_3$ composed of a cork and rubber agglomerate, said layer comprising, for example, perforations $17_3a$ distributed around to its periphery, with one perforation in its center $17_3b$. Said perforations form, when the coating layer is fixed, for example, by adhesive bonding on the said bent surfaces, blind holes containing air. The effect of this being to prevent the lenses from adhering during the polishing operation and to facilitate their removal after said operation.

The member is extended downwards by an enclosing part constituted by a skirt of general cylindrical shape 17*a*, comprising a conical part 17*b* which is joined to the upper part comprising the bearing surface $17_1/17_2$. The part 17*a* comprises a ledge 17*c* which extends inside the member, said ledge being contained in a plane perpendicular to the longitudinal axis of the member and defines a circular opening 17*d* and therefore is parallel to the upper part which comprises the bearing surfaces $17_1/17_2$.

The lens-support further comprises, beneath the bearing surface $17_1/17_2$ and co-axially thereto and to the opening 17*d*, a conical recess 17*e*, the generating lines of the wall of which converge into a point situated beyond the bearing surface $17_1/17_2$ and on the longitudinal axis of the support. The bottom of said recess is dish-like 17*f*, the conicity of said dish 17*f* being more pronounced than that of the side wall.

Referring now to FIG. 5 of the drawing, this illustrates the lens-support shown in FIG. 6, borne by the spindle 22, mounted in sleeve 23.

The spindle 22 is provided at its upper part with a head 31 mounted for free rotation, which head is conical and has the same conicity as the recess 17*e* of the support in which it is engaged. Said head is composed of two parts: a central part 31*a* forming a sort of plate at its lower part and a conical part 31*b* which encloses the said central part 31*a*, part 31*b* being mounted for rotating on the part 31*a* by way of a ball bearing 32, fitted around the central part 31*a* inside a cylindrical recess 31*d* of the conical part 31*b*.

Said central part 31*a*, which is fixed, comprises a conical recess $31a_1$ the top of which is directed towards the upper part of the head 31, which upper part rests in a detachable wearing part in carbide steel.

Said head 31 rests on a pivot 34, which is also in carbide steel, and has the shape of a cylindrical axle, the free end of which is conical with the same conicity as the housing $31a_1$ and the detachable part 33. Said pivot 34 is mounted on a cylindrical endpiece 35 which comprises a threaded and cylindrical co-axial extension, screwed into a tapped hole 22*b*, provided in the middle and at the upper part of the spindle 22. A cup-shaped member 36, of downwardly extending cylindrico-conical shape, covers the upper part of the sleeve 23 which at this end forms a cylindrical boss 23*e*. Said sleeve comprises at the level of said boss 23*e*, an annular housing 23*f* containing a lip-joint 37, the lip of which rests around the spindle 22.

The circular opening diameter 17*d* is less than the diameter (2R) of the flared part forming the bearing surfaces, and more than its width e. This condition is necessary to allow the fitting of the lens-support over the head 31 and its removal therefrom.

To perform these two operations, the spindle 22 is placed in the position shown in FIG. 5, the lens-support is placed in an inclined position, so that one of its bearing surfaces 23*d* comes through the opening 17*d*. The lens-support is thereafter placed in a substantially horizontal position and is moved towards the opposite bearing surface so that the latter comes through the opening 17*d*; simultaneously to these two operations, the head 31 is engaged in the conical recess 17*e*.

In the position shown in FIG. 5, the lens-support is in the position wherein the lenses are polished. The ledge 17*c* being at a distance from the two bearing surfaces 23*d*, said support can oscillate about the pivot 34 whilst being driven in rotation about the ball bearing 32 under the effect of the oscillating tool-holding head 2, the tool 8 of which attacks the lens in a "band-like" position, namely towards the periphery of the lens.

To deposit the lens on the support or to remove it therefrom, and to immobilize the support in a perfectly defined horizontal position, since these operations are carried out mechanically by arms to be described hereinafter, the lens-support 17 is pushed towards the oscillating head 2, under the effect of the jack 24 which carries the spindle 22, until the ledge 17*c* of the support is resting on the bearing surfaces 23*d* of the sleeve 23, such as illustrated in FIG. 3 of the drawing. In this position, the part of the lens-support $17_1/17_2$ receiving the lenses is immobilized inside a horizontal plane.

Figure 11:
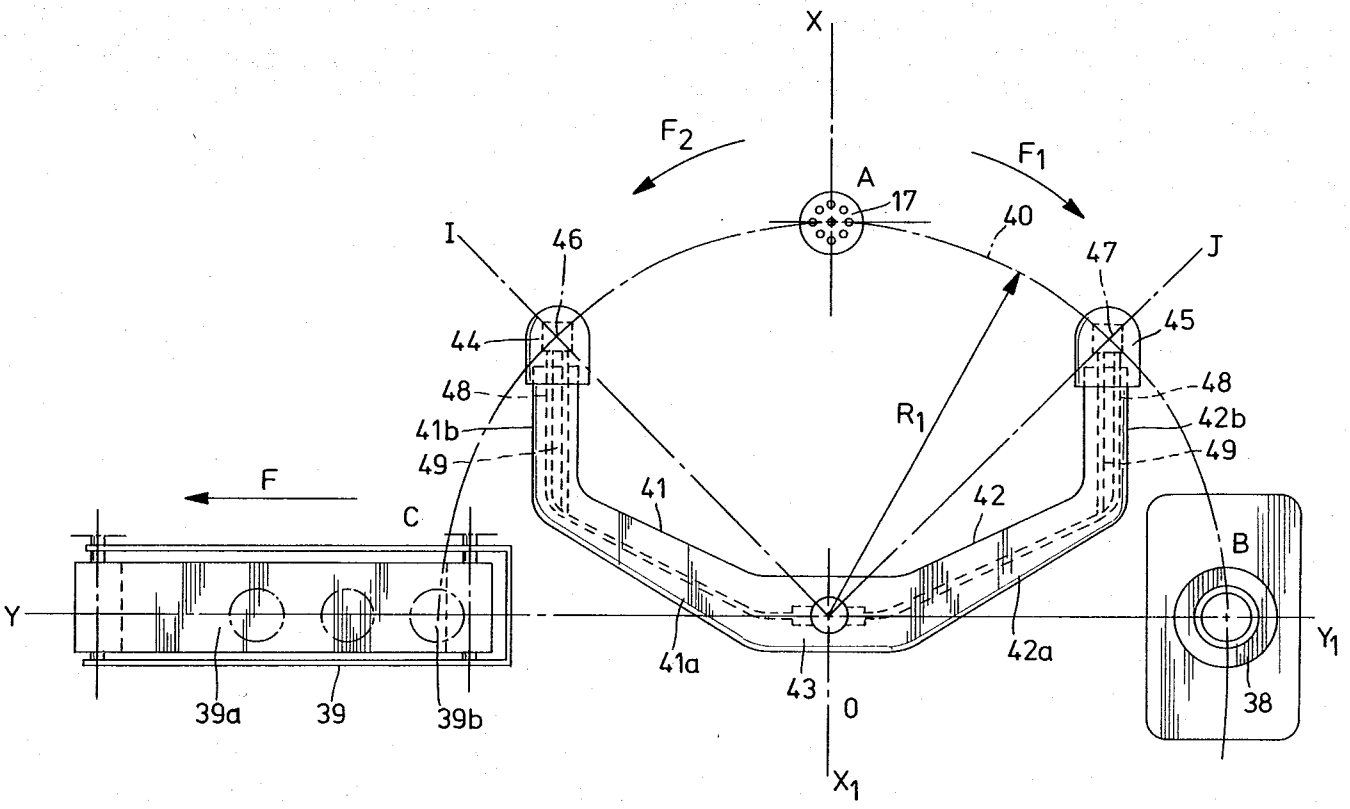
FIG. 11 is a diagrammatical plan view illustrating the transfer device in a machine equipped with one polishing device to grind or polish one face of the lenses.

Referring now to FIG. 11, this illustrates diagrammatically a machine comprising a lens-polishing installation.

Such a machine is composed of three stations:

A—surface-treating station

B—lens-supplying station

C—removal station for removing the lenses polished on one face.

Stations A and B/C are situated on two orthogonal axes $XX_1/YY_1$ which intersect at a point 0. Station A is facing the operator and comprises the lens-support 17 above which is situated the oscillating tool-holding head 2. Station B and station C are on the same line $YY_1$. Station B is situated on the right of station A, and station C on the left.

Station B supplying the lenses comprises a vertical magazine 38 which is in the form of a hollow cylindrical body in which the lenses are stacked above a push-member.

Station C for removing the polished lenses is constituted by a conveyor belt 39, the carrying part 39*a* of which moves in the direction of arrow F.

The end 39*b* of said conveyor, station A and station B are all situated on a circumference 40 of radius $R_1$.

The machine also comprises a two-arm assembly 41/42, these arms being mounted for pivoting about an axis situated at the point 0 of intersection of the lines $XX_1/YY_1$. Said arms 41/42 are situated inside the same horizontal plane, and are joined one to the other by a part 43. Each comprises a part 41*a*/42*a*, which diverge from point 0 and a part 41*b*/42*b* which is parallel to line $XX_1$, when the arms are in their initial rest position such as shown in FIG. 11. Each arm carries at its free end a suction-grip 44/45. Said suction-grips are situated at the point of intersection of the bisectors of the angles formed by orthogonal lines $XX_1/YY_1$ with the circumference 40 on which the suction grips move. Thus, in the rest position, the suction-grip 44 is situated at the point of intersection 46 of the circumference 40 with the bisector line OI of the angle AOC, and the suction-grip 45 is situated at the point of intersection 47 of the bisector line OJ of the angle AOB with the said circumference 40. The lines OI/OJ forming a right angle.

In each of said suction-grips 44/45 issues a compressed air conduit 48 and a depressurized air conduit 49. Said conduits are fixed to the arms and connected, via hose pipes, the conduit 49 to a vacuum pump, and the conduit 48 to a compressor.

The device shown in FIG. 11 works as follows:

At the start:

The oscillating tool-holding head 2 is disengaged from the lens-support 17.

(a)—The arms 41/42 pivot over 45° in the direction of arrow $F_1$, the suction-grip 44 stops above the support 17, and the suction grip 45 above the tubular magazine 38.

(b)—Downward translation of the arms, simultaneously the push-member of the magazine 38 pushes up the stack of lenses in order to bring the upper lens in contact with the suction-grip 45 of the arm 42.

(c)—The suction grip 45 sucks up the lens under the effect of the vacuum pump.

(d)—Upward translation of the arms, the arm 42 carrying the lens.

(e)—Rotation of the arms over 90° in the direction of arrow $F_2$, the suction-grip 45 is immobilized above the lens-support 17.

(f)—Downward translation of the arms to deposit the lens on the support 17, a jet of compressed air being used to apply the lens on to the lens-support 17 and upward translation of the arms.

(g)—Pivoting of the arms over 45° to immobilize the suction-grips 44/45 in their initial position above the points 46/47.

(h)—Lowering of the oscillating tool-holding head 2 on to the lens borne by the lens-support 17 to grind or polish it on one face.

During operations b to g above, conducted by the arm 42:

(b)—Upward translation of the arms, the suction-grip 44, carried by the arm 41, comes into contact with the precedingly shaped lens.

(c)—The suction-grip 44 sucks up the shaped lens.

(d)—Upward translation of the arms, arm 41 carrying the lens.

(e)—Pivoting of the arms over 90° in the direction of arrow $F_2$, the suction-grip 44 is immobilized over the end 39*b* of the conveyor belt 39.

(f)—Downward translation of the arms, the arm 41 moves closer to the conveyor belt and a jet of compressed air causes the lens to drop on to said belt 39*a*. The lenses are taken away in the direction of arrow F towards a storage box.

(g)—Upward translation of the arms which are pivoted over 45° to immobilize the suction-grips 44/45 in their initial position over the points 46/47;

And the cycle is repeated as many times as there are lenses in the tubular magazine 38.

The lenses polished on one face are dis posed in a magazine 38 in order to polish their other face, in the same way as described hereinabove in (a) to (h).

Figure 12:
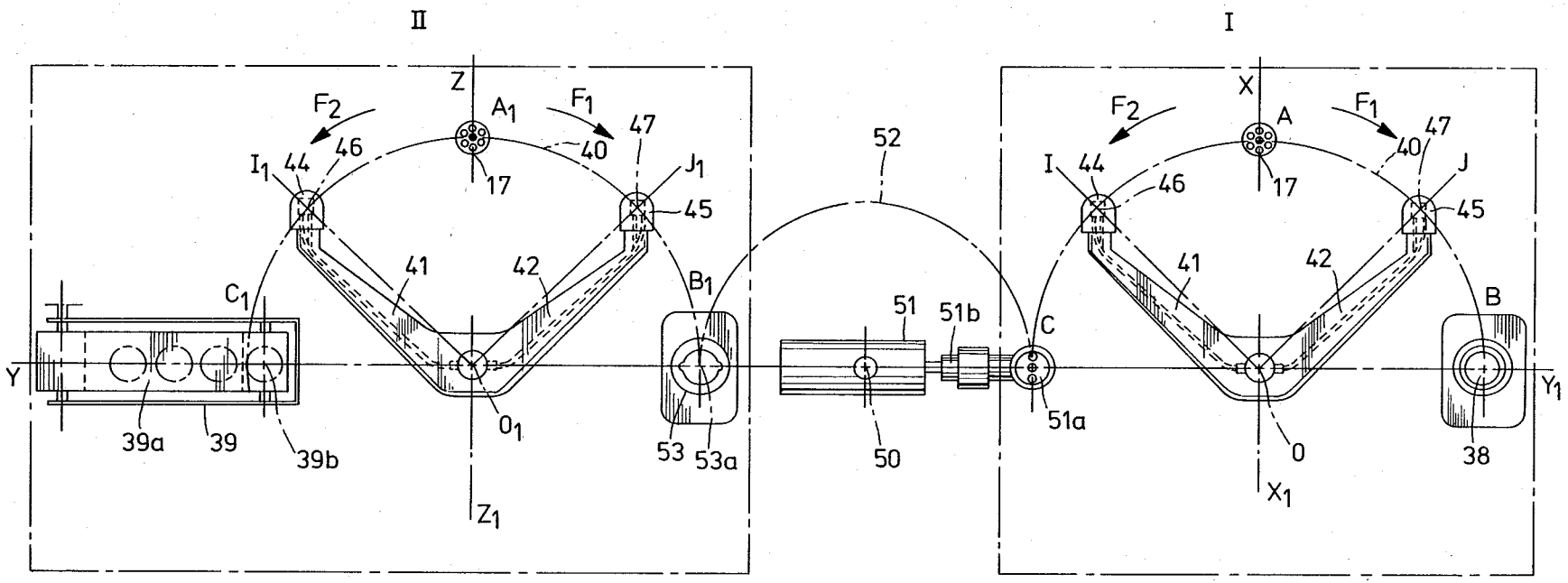
FIG. 12 is a diagrammatical plan view illustrating the transfer device of a machine equipped with two polishing devices for grinding or polishing the lenses on two faces.

FIG. 12 diagrammatically shows a machine with two devices for polishing the two surfaces of the lenses.

The two devices I/II are juxtaposed.

Device I comprises three stations A, B, C.

A—Surface polishing station

B—Lens-supplying station

C—Transfer station transferring the lenses polished on one face towards device II.

Stations A and B/C are situated on two orthogonal axes $XX_1/YY_1$ which intersect at a point 0.

Device II also comprises three stations $A_1$, $B_1$, $C_1$.

$A_1$—Surface-polishing station $B_1$—Relay-station for the lenses coming from Device I $C_1$—Removal station to remove the lenses polished on two faces.

Stations $A_1$ and $B_1/C_1$ are situated on two orthogonal axes $ZZ_1/YY_1$ which intersect at a point $0_1$.

Stations B, C,$B_1$, $C_1$ are aligned on axis $YY_1$.

A transfer device 51, also called turning-over member, is mounted for pivoting about an axle 50, between the two devices I and II, said transfer device comprising a lens-receiving member 51*a* carried by an arm 51*b*. The pivoting axle 50 is situated on the axis $YY_1$ in the middle of the distance separating station $B_1$ from station C. The lens receiving member 51*a* describes a circle 52 to transfer the lenses from station C to station $B_1$.

The arms 41/42 of the two devices I and II are inside the same horizontal plane and they are identical and arranged in the same way as on the machine described hereinabove with reference to FIG. 11. Like on that machine, at station A of the device I, there is provided a lens-support 17 topped by an oscillating tool-holding head 2; at station B is provided a lens magazine 38 identical to that described hereinabove.

Also, as on the machine of FIG. 11, there is provided at station $A_1$ of the device II, a lens-support 17 topped with an oscillating tool-holding head 2; at station $C_1$ is provided a conveyor belt 39 identical to that described hereinabove.

Said device II comprises at station $B_1$, a relay-support 53 composed of a hollow circular receptacle 53*a* coated on its surface with a layer of soft synthetic material, such as, for example, polyurethane, in which receptacle the lenses which have been treated on one face are deposited by the turning over member 51. In the center of the receptacle 53*a* is provided an orifice through which is delivered a jet of water to wash the face of the precedingly polished lens.

The turning over member 51 pivots about axle 50 under the effect of a double acting jack (not shown) the movable rod of which is equipped with a toothed rack which meshes with a pinion wedged on the said axle 50.

Whilst the member 51 is pivoted over 180° from station C to station $B_1$ (or vice-versa) the arm 51*b* which carries the lens-receiving member 51*a* also pivots over 180° so that the lens deposited on the receiving member 51*a* at station C is turned over and deposited on the relay support 53 of the station $B_1$.

Said receiving member 51*a* is in the form of a circular casing of diameter slightly larger than that of the lens-support and of which the bottom is coated with a layer of polyurethane, for example.

The rotation about its own axis of the arm 51*b* during the 180° rotation of the turning-over member is obtained by means of a bevel coupling of which one pinion is wedged on the end of the arm 51*b* and the other is wedged on the end of the axle 50.

The machine with the two devices works as follows:

At the start, the oscillating heads 2 of the devices I and II are disengaged from the lens-support 17.

On device I:

(a) The arms 41/42 pivot over 45° in the direction of arrow $F_1$, the suction-grip 44 stops above the support 17, and the suction-grip 45 above the tubular magazine 38.

(b) Downward translation of the arms, simultaneously the push-member of the magazine 38 pushes up the stack to place the upper lens in contact with the suction-grip 45 of the arm 42.

(c) The suction-grip 45 sucks up the lens under the effect of the vacuum pump.

(d) Upward translation of the arms, arm 42 carrying the lens.

(e) Pivoting of the arms over 90° in the direction of arrow $F_2$ the suction grip 45 stops over the support 17.

(f) Downward translation of the arms to deposit the lens on the support 17, a jet of compressed air being used to apply said lens on the lens-support 17 and upward translation of the arms.

(g) Pivoting of the arms over 45° to immobilize the suction-grips 44/45 in their initial position above the points 46/47.

(h) Lowering of the tool-holding oscillating head 2 on to the lens laid on the support 17 with a view to polishing one of its faces.

During operations b to g carried out by the arm 42:

(b) Downward translation of the arms, the suction grip 44 borne by the arm 41 comes into contact with the precedingly shaped lens.

(c) The suction-grip 44 sucks up the shaped lens.

(d) Upward translation of the arms, arm 41 carrying the lens.

(e) Pivoting of the arms over 90° in the direction of arrow $F_2$, the suction-grip 44 stops above the lens-receiving member 51*a*.

(f) Downward translation of the arms, the arm 41 comes closer to the lens-receiving member 51*a*, a jet of air being used to cause the lens to drop into the receiving member.

(g) Upward translation of the arms, and pivoting over 45° so that the suction-grips 44/45 stop in their initial position over the points 46/47.

During the polishing of the lens at station A:

Pivoting over 180° of the turning-over member 51*b* in order to place the lens, already polished on one face, in the recovery position on the relay-support 53, with a view to polishing the second face.

During operations a to h conducted on device I, the operations conducted on device II are as follows:

(a) The arms 41/42 pivot over 45° in the direction of arrow $F_1$, the suction-grip 44 is immobilized above the support 17 and, the suction-grip 45 above the relay-support 53.

(b) Upward translation of the arms.

(c) The suction-grip 45 sucks up the lens under the effect of the vacuum-pump.

(d) Upward translation of the arms, arm 42 carrying the lens.

(e) Pivoting of the arms over 90° in the direction of arrow $F_2$, the suction-grip 45 is immobilized above the support 17.

(f) Downward translation of the arms to deposit the lens on the support 17, a jet of air being used to apply the lens against said support, and upward translation of the arms.

(g) Pivoting of the arms over 45° to immobilize the suction-grips 44/45 in their initial position over points 46/47.

(h) Lowering of the oscillating tool-holding head 2 on the lens resting on the support 17 to polish the second face thereof.

During operations b to g conducted by the arm 42:

(b) Downward translation of the arms, the suction-grip 44 borne by the arm 41 comes into contact with the precedingly shaped lens.

(c) the suction-grip 44 sucks up the lens polished on both faces.

(d) Upward translation of the arms, arm 41 carrying the lens.

(e) Pivoting of the arms over 90° in the direction of arrow $F_2$, the suction grip 44 being immobilized above the end 39*b* of the conveyor 39.

(f) Downward translation of the arms, the arm 41 coming closer to the conveyor belt, a jet of compressed air being used to cause the lens to drop on to the belt 39*a*. Removal of the lenses treated on both faces in the direction of arrow F towards a storage box.

(g) Upward translation of the arms and pivoting of the arms over 45° to immobilize the suction-grips 44/45 in their initial position above the points 46/47.

And the cycle is repeated synchronously on devices I and II.

The polishing operations carried out at station A, $A_1$ and the transfer of the lenses by the turning over member 51 and by the conveyor belt 39, are simultaneous.

What we claim is:

1. A machine for grinding or polishing optical lenses, comprising a frame on which is mounted at least one spindle designed to carry a tool, at least one lens-support, means for delivering a polishing agent between the tool and the support, means to bring the lenses in contact with the tool, means to place the lenses on the lens-support and to remove the lenses therefrom, said lens-support being mounted for free rotation on said frame, said frame including an oscillating movable head on which the tool-holding spindle is driven in rotation above the lens-support; wherein the lens-support is carried by a vertically movable lens-support spindle mounted in a sleeve which is flared at the top to form two bearing surfaces extending horizontally and opposedly on opposite sides of the lens-support spindle; wherein the lens-support is downwardly extended by a skirt, said skirt being provided with a lower horizontal ledge extending towards the center of said support to enclose the part of the sleeve which comprises said bearing surfaces; and wherein said lens-support rests on a lens-support spindle head mounted for free rotation on a fixed pivot situated at the top of said lens-support spindle, so that when the lens-support spindle moves upwardly, the lens-suport comes to rest on said bearing surfaces and is immobilized in a horizontal position to lay the lenses thereon, in order to polish them, or to remove them once they have been polished, and so that when the lens-support spindle moves downwards, the lens-support, being apart from said bearing surfaces, can oscillate freely during the polishing of the lenses under the influence of the oscillating movable head.

2. A machine as claimed in claim 1, wherein the head supporting the lens-support has an upper part and has a generally truncated cone shape having a certain conicity, the surface lines of said cone converging to a point situated on its rotation axis and beyond the upper part of said cone, and is comprised of two parts, a first fixed central part, provided in its center with a conical recess having a top, the top of which is directed towards the upper part of said head, on which top rests the pivot, and a second part enclosing said central part and being mounted for free rotation on said fixed part by way of a ball or roller bearing.

3. A machine as claimed in claim 2, wherein the lens-support has an upper part and is provided, with a conical recess in the center of its upper part having a conicity generally equal to the conicity as said head so that the lens-support is centered on the lens-support spindle head.

4. A machine as claimed in claim 3, wherein the lens-support includes, at its upper part, a surface of generally spherical shape, on which surface is deposited the lens to be ground or polished; and wherein said surface is defined by a ledge to hold the lens during the polishing operation and covered with a cork and rubber agglomerate, said covering having perforations to prevent any suction effect from the lenses and aid their removal after the polishing or grinding operation.

5. A machine as claimed in claim 4, wherein said ledge is situated at the lower part of the lens-support, defines a circular opening, is situated within a plane perpendicular to the axis of rotation of the lens-support, and is parallel to the upper part of the lens-support that includes the surface of general spherical shape.

6. A machine as claimed in claim 1, wherein the tool is cylindrical and has a working surface of general spherical shape; wherein the tool-holding surface has a lower part and an upper part; wherein said tool is secured on the lower part of the tool-holding spindle and co-axially thereto by means of an externally threaded hollow axle, said axle cooperating with a tapped hole provided in the tool-holding spindle, inside which hollow axle is slidably mounted a push-member having a lower part which extends from the lower part of the tool and an upper part which extends up to the upper part of the axle and beyond, said push-member being held in position by means of a compression spring resting on a shoulder of said axle; and wherein the tool-holding spindle is hollow through most of its length and includes a rod secured to a jack situated above the upper part of said tool-holding spindle, said rod extending inside said tool-holding spindle so that its lower end is situated, when in its initial rest position, close to said push-member and when the jack is pressurized, the rod comes to rest against the push-member and urges the push-member in translation into the hollow axle and causes the lower part of the push-member to emerge on the periphery of the tool in order to push the lens off the tool and against the outer surface of the lens-support.

7. A machine as claimed in claim 6, wherein the threaded axle includes, at its lower part, a cylindrical head restable on a shoulder provided at the bottom of a cylindrical recess inside the tool; wherein said push-member includes a rod having, at its lower end, a cylindrical protuberance moving inside a chamber provided in the cylindrical head of the threaded axle, said cylindrical protuberance being provided, at one end, with a blind hole forming lateral pans to receive a spanner and being provided, between said blind hole and said rod, with a slot cutting through it; and wherein said push-member is secured in rotation with the said threaded axle by way of a pin integral with said axle and extending through said slot to permit the translational displacement of the push-member with respect to the threaded axle.

8. A machine as claimed in claim 7, further comprising one device for polishing the surfaces of the lenses, and wherein the means used to place the lenses in contact with the tool and to remove them are two arms situated on the same horizontal plane and mounted for rotation about the same vertical axis, each arm including, at its free end, a suction-grip into which issues a pressurized air pipe and a depressurized air pipe, the suction-grips moving along a circumference on which is situated a surface-polishing station, with the lens-support and the tool-holding spindle, and a tubular magazine in which the lenses to be polished are stacked.

9. A machine as claimed in claim 8, wherein the surface-polishing station and the tubular magazine are situated on two orthogonal lines intersecting on the axis of rotation of said arms; and wherein the suction-grips are, when in their initial rest position, situated on a line which bisects the angles formed by the said orthogonal lines, so that when the arms pivot in one direction, the suction-grips stop above the lens-support and the tubular magazine and when the arms pivot in the other direction, the suction-grips stop above the lens-support and an end of a conveyor belt used to direct the lenses polished on one face towards a storage means.

10. A machine as claimed in claim 7, further comprising two juxtaposed surface-polishing devices, wherein the means used to place the lenses in contact with the tools and to remove them are two sets of arms situated on the same horizontal place, each set of arms being mounted for rotation about a vertical axis, and each arm being equipped at its free end with a suction-grip into which issues a pressurized air pipe and a depressurized air pipe, the suction-grips of each set of arms moving along a circumference on which are situated, in one of the juxtaposed surface-polishing devices, a surface-polishing station, with a lens-support and a tool-holding spindle, a tubular magazine in which are stacked the lenses to be treated, and a lens-turning-over member for placing said lenses in a polishing position on a relay-support of the other juxtaposed surface-polishing device; and wherein the suction-grips of the other set of arms of the other juxtaposed surface-polishing device move along a circumference on which are situated the relay-support on which the lens-turning-over member deposits the lenses with a view to polishing their second face, a surface-polishing station, with a lens-support and a tool-holding spindle, and an end of a conveyor belt used to direct the lenses which have been polished on both faces towards a storage means.

11. A machine as claimed in claim 10, wherein the surface-polishing station and tubular magazine of one of said juxtaposed surface-polishing devices are situated on two orthogonal lines intersecting on the axis of rotation of one of the sets of arms whose suction-grips are, when in their initial rest position, situated on a line which bisects the angles formed by the orthogonal lines, so that when the arms are pivoted in one direction, the suction-grips stop with one set of arms above the lens-support and the other set of arms above the tubular magazine, or when the arms are pivoted in the other direction opposite said one direction, the suction-grips stop with one set of arms above the lens-support and the other set of arms above a lens-receiving member of the lens-turning-over member, in order to deposit on said lens-receiving member the lens which has just been polished on one face; and wherein the surface-polishing station and said relay-support of the other juxtaposed surface-polishing device are situated on two orthogonal lines intersecting on the vertical axis of rotation of the other set of arms whose suction-grips are, when in their initial rest position, situated on a line which bisects the angles formed by the orthogonal lines, so that when the arms are pivoted in one direction, the suction-grips stop with one above the lens-support and the other above the relay support, or when the arms are pivoted in the other direction opposite said one direction, the suction-grips stop with one above the lens-support and the other above an end of a conveyor belt used to direct the lenses which have been polished on both faces towards a storage means.

12. A machine as claimed in claim 11, wherein the lens-turning over member adopts the general shape of an arm having, at its free end, the lens-receiving member, said arm being mounted for pivoting about a vertical axis and including means to pivot it over 180° inside a horizontal plane and to pivot it about its own axis in order to cause the lens-receiving member to turn over 180° and, in doing so, deposit the lens on the relay-support and place it in such a position as to have its second face polished.

* * * * *